United States Patent [19]

Meaden et al.

[11] 3,978,753

[45] Sept. 7, 1976

[54] ADJUSTABLE PERFORATOR WHEEL

[75] Inventors: Thomas F. Meaden, LaGrange; George W. Fieberg, Melrose Park, both of Ill.

[73] Assignee: Meaden Screw Products Company, Chicago, Ill.

[22] Filed: Jan. 12, 1976

[21] Appl. No.: 648,748

[52] U.S. Cl. ..... 83/678; 83/332

[51] Int. Cl.[2] ..... B26F 1/20

[58] Field of Search ..... 83/332, 678; 93/58.1, 93/58.2 R, 58.4

[56] References Cited

UNITED STATES PATENTS

| | | | |
|---|---|---|---|
| 3,067,643 | 12/1962 | Ward, Jr. | 83/332 |
| 3,152,501 | 10/1964 | Nassar | 83/332 X |
| 3,408,735 | 11/1968 | Eisler | 83/332 X |

*Primary Examiner*—J. M. Meister

*Attorney, Agent, or Firm*—Wegner, Stellman, McCord, Wiles & Wood

[57] ABSTRACT

An adjustable perforator wheel for use in providing a tear line in a sheet-type workpiece. The perforator wheel includes a pair of slotted wheels which are adjustably related to define a preselected smaller slot between elongated slitting portions of the wheel. The slots in the respective first and second wheels may be of relatively large size for facilitated manufacture with the resultant small slot being of extremely small size as desired.

13 Claims, 5 Drawing Figures

ADJUSTABLE PERFORATOR WHEEL

BACKGROUND OF THE INVENTION

1. Field of the Invention

This invention relates to slitting means and in particular to perforator wheels.

2. Description of the Prior Art

In one conventional form of perforator wheel, a wheel having a beveled cutting edge is provided at angularly spaced intervals with notches. Thus, as the wheel is run against a workpiece, such as a sheet of paper or cloth, the cutting edge slits the workpiece with the slots defining unslit portions of the workpiece between relatively longer slit portions. As the slots are relatively small in width, the unslit portion of the workpiece defines a relatively frangible portion which may be readily torn apart, whereby the slit edge defines a tearing edge in the sheet.

A problem arises in the manufacture of such perforator wheels where the slots are to be made relatively small in width to define relatively small nonslit portions in the tearing edge. Illustratively, slots having a width of approximately 0.030" may be readily ground in the peripheral cutting edge of the perforator wheel. However, when slots of relatively small width, such as 0.010" or smaller, are to be provided, the grinding thereof is very costly.

A number of perforating wheels are shown in the prior art. Illustratively, in United States Letters Pat. No. 170,873 of Phillip McAleer, a paper perforating machine is provided with wheels having radial slots. As discussed above, such slots provide nonslit portions in the sheet material and it is difficult to manufacture such wheels with relatively small width slots.

In United States Letters Pat. No. 1,414,239 of W. J. Warren, a wire cutter is illustrated having a pair of rotary blades which are rotated in opposite directions to effect the desired cutting of the wire.

George F. Taylor, in United States Letters Pat. No. 1,904,568, shows a disk like cutting tool having a pair of wheels for use such as in cutting glass and the like, with the wheels being formed of a mixture of cobalt and tungsten carbide, and a pair of outer metal disks.

Frank Nassar, in United States Letters Pat. No. 3,152,501, shows a paper perforating attachment for printing presses wherein the perforating wheel, which comprises a hardened steel wheel, has a plurality of radial slots.

Kenneth T. Buttery, in United States Letters Pat. No. 3,255,648 and 3,255,649 discloses means and methods for forming weakened severance lines in paperboard products. The Buttery wheels are formed of two elements with alternating toothed portions such that secondary cuts are positioned in registry with the interstices between primary cuts, and primary cuts are positioned in registry with the interstices between the secondary cuts.

Robert P. DeTorre, in United States Letters Pat. No. 3,593,899, shows a glass-scoring process utilizing a scoring wheel having dual scoring edges in spaced side-by-side relationship.

SUMMARY OF THE INVENTION

The present invention comprehends an improved perforator wheel structure for providing adjustable length spaced tear portions in a workpiece sheet, such as a paper sheet. The tear portions are defined by nonslit portions of the workpiece sheet disposed between elongated slit portions thereof. The sheet may comprise a discrete flat sheet or sheet material fed from a roll thereof, as desired.

More specifically, the invention comprehends providing such a perforator wheel structure comprising first and second cutter wheels, each having a peripheral cutting edge provided with a plurality of circumferentially spaced slots. Means are provided for adjustably coaxially securing the first and second wheels with the cutting edges juxtaposed and with the slots of each wheel overlapping so as to define smaller resultant slots in the cutting edge of the perforator wheel structure.

Illustratively, the slots in the first and second wheel portions may have a length of approximately 0.030" with the overlapping of the slots permitting a reduction in the size of the resultant slot to below 0.030" and, illustratively, in the range of 0.010" or less.

The slots may be ground in the first and second wheels by relatively low cost grinding operations notwithstanding the provisions of heat-hardened cutting edge portions in the wheels.

The securing means may comprise a mounting hub for the first and second wheels with the wheels being press-fitted or threaded thereto in the desired adjusted relationship.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
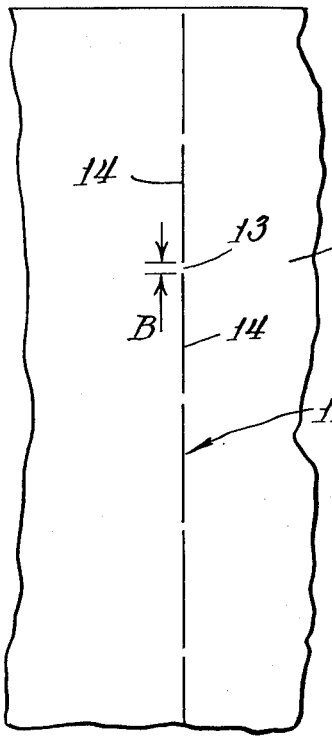
FIG. 1 is a fragmentary plan view of a workpiece sheet having a tearing edge formed therein by a perforator wheel structure embodying the invention.

In the exemplary embodiment of the invention as disclosed in the drawing, a perforator wheel structure generally designated 10 provides a sheet tearing perforation line generally designated 11 in a workpiece sheet 12. The workpiece sheet may comprise a conventional sheet of slittable material, such as paper, paperboard, textile fabric material, etc., adapted to be slit by the urging of a sharp cutting edge thereagainst.

The present invention is concerned with providing such a perforation line having extremely small nonslit portions 13 between elongated slit portions 14 thereof.

As indicated above, such perforation lines may be formed in such material by cutting wheels having notches in a sharp peripheral cutting edge portion thereof.

The present invention comprehends providing a perforator wheel structure 10 made up of a first perforator wheel 15 and a second perforator wheel 16 cooperatively defining the perforator wheel structure 10 and having a plurality of slots 17 defined by a corresponding plurality of first slots 18 in wheel 15 and second slots 19 in wheel 16.

Figure 4:
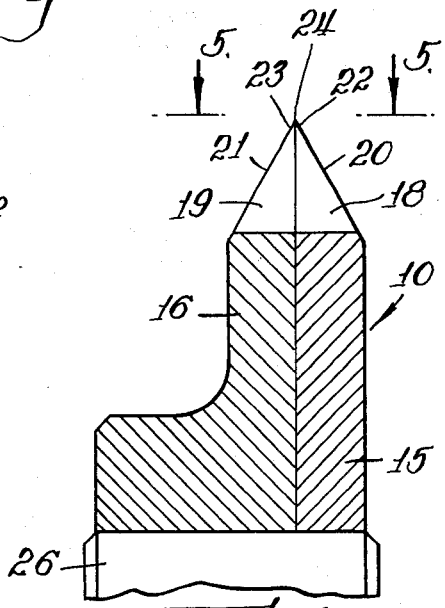
FIG. 4 is a fragmentary enlarged vertical section taken substantially along the line 4–4 of FIG. 3.
Figure 5:
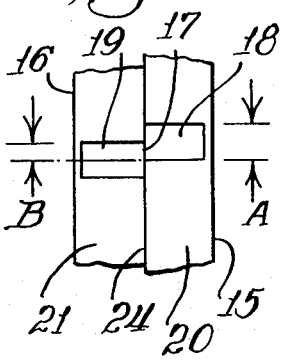
FIG. 5 is a fragmentary top plan view of a portion of the cutting edge of the perforator wheel structure illustrating the overlapped relationship of the individual wheel slots to define a smaller sheet slitting slot.

As best seen in FIGS. 4 and 5, the small slot 17 is defined by the overlap between slots 18 and 19 in the respective cutting wheels effected by a suitable secured adjusted positioning of the two cutter wheels.

Figure 2:
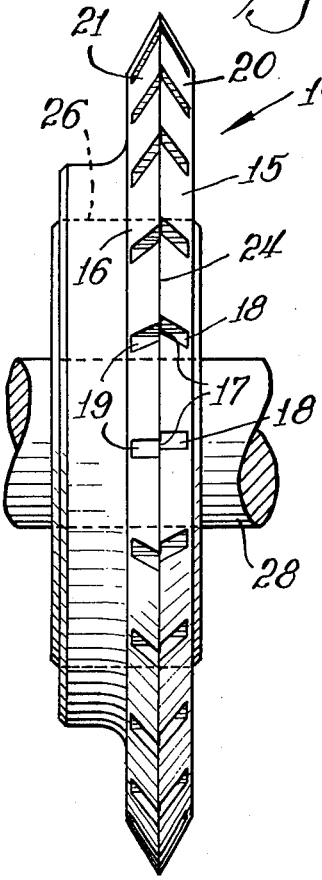
FIG. 2 is a side elevation of the perforator wheel structure.
Figure 3:
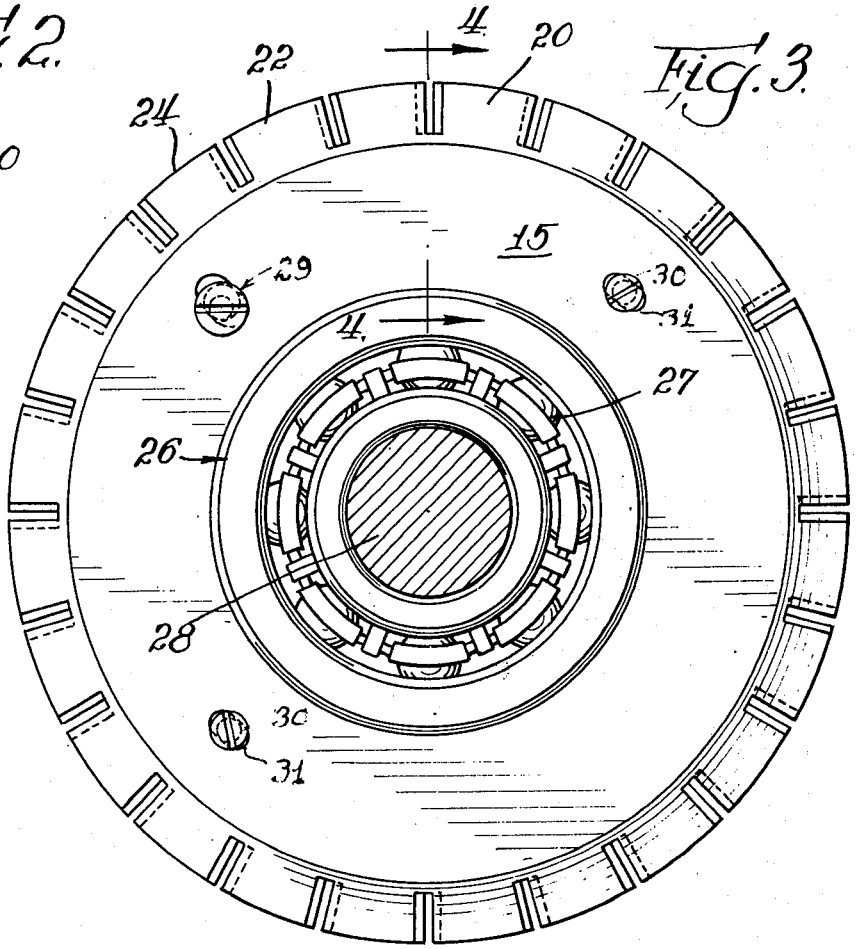
FIG. 3 is a front elevation thereof.

As best seen in FIGS. 2 and 3, the cutter wheels are defined by annular elements having peripheral beveled portions 20 and 21, respectively, defining outermost cutting tips 22 and 23. The bevels taper away from each other, as shown in FIG. 4, so that when the cutting wheels are facially juxtaposed, as shown in FIG. 4, the individual cutter wheel tips 22 and 23 cooperatively define a tapered slitting edge 24 of the composite perforator wheel structure 10.

The composite cutting edge 24 provides the elongated slits 14 in the workpiece 12 and the short composite slot 17 defines the nonslit portions 13 therein. Thus, it may be seen that cutter wheel 15 may be adjusted angularly relative to cutter wheel 16 so as to provide any desired overlap therebetween from an aligned nonoverlapping relationship of the slots 18 and 19 down to a fully disaligned fully overlapping relationship. Thus, an infinite number of different size slots 17 may be obtained which may have extremely small width while yet permitting the slots 18 and 19 to be relatively large width slots readily manufactured in the cutting wheel portions 20 and 21 by conventional grinding tools.

More specifically, in the illustrated embodiment, slots 18 and 19 may have a width of approximately 0.030" with the slots 17 being of any desired size from 0.030" down to substantially 0", as desired.

The cutter wheels may be secured in the adjusted position by the mounting thereof on a suitable mounting member 26, which may comprise a hub member provided with suitable bearings 27 for mounting of the cutting wheel on a shaft 28. To readjust the size of the slot 17, one of the cutting wheels may be removed from the hub member and reinstalled thereon in the newly desired angular relationship.

It has been found that a highly desirable slot width for use in perforating paper and the like is one having a width dimension of approximately 0.010" to 0.005". As indicated above, the present invention is ideally suited for providing such slot widths economically notwithstanding the formation of the cutting wheel cutting portions of heat-hardened material. As indicated above, the slots 18 and 19 may be readily formed to extend parallel to the axis of the wheels by a simple grinding operation which may be effected by conventional grinding tools.

In the illustrated embodiment, the slots 18 and 19 are of equal width although, as will be obvious to those skilled in the art, different width slots may be utilized as desired.

The press-fit of the cutting wheels provides a positive secured relationship therebetween while yet permitting the slot 17 to be accurately sized to have such extremely small dimensions, as discussed above.

Thus, the perforator wheel structure of the present invention is extremely simple and economical of construction while yet providing the highly desirable features discussed above.

As shown in FIG. 3, one means for effecting adjustment of the length of the spaced tear portions in the workpiece sheet may comprise screw means extending between the perforator wheels. The screw means may include an overcenter screw 29 and a plurality of locking screws 30. The overcenter screw may effect a rotation of wheel 15 relative to wheel 16 by a camming action as a result of a threaded adjustment of the screw in mounted association with wheel 16. To accommodate the rotational adjustment of wheel 15 relative to wheel 16, wheel 15 may be provided with a plurality of arcuate slots 31 through which screws 30 extend in being threadedly secured to perforator wheel 16. The camming action of screw 29 provides a fine adjustment of the slot lengths with the screws 30 positively securing the wheels in the adjusted position.

The foregoing disclosure of specific embodiments is illustrative of the broad inventive concepts comprehended by the invention.

I claim:

1. A perforator wheel structure for providing adjustable length spaced tear portions in a workpiece sheet, said perforator wheel structure comprising:

a first wheel having a peripheral cutting edge provided with a plurality of circumferentially spaced first slots;

a second wheel having a peripheral cutting edge provided with a corresponding plurality of circumferentially spaced second slots; and means adjustably coaxially securing said first and second wheels with said cutting edges juxtaposed and with said first slots overlapping said second slots to define nonslitting portions of said perforator wheel structure selectively having any one of a plurality of different lengths.

2. The perforator wheel structure of claim 1 wherein said securing means comprises an axial mounting hub.

3. The perforator wheel structure of claim 1 wherein said wheels are press-fitted to a mounting member.

4. The perforator wheel structure of claim 1 wherein said slots have a length circumferentially of the wheel edge of approximately 0.030".

5. The perforator wheel structure of claim 1 wherein said nonslitting portions have a length of approximately 0.005" to 0.010".

6. The perforator wheel structure of claim 1 wherein said nonslitting portions have a length of less than approximately 0.010 inch.

7. The perforator wheel structure of claim 1 wherein said wheel cutting edges comprise hardened edges.

8. The perforator wheel structure of claim 1 wherein said first and second slots have substantially equal lengths circumferentially of the wheel cutting edges.

9. The perforator wheel structure of claim 1 wherein said slots extend parallel to the axis of each wheel.

10. The perforator wheel structure of claim 1 wherein said slots comprise ground recesses in said wheel peripheral cutting edge.

11. A perforator wheel structure for providing adjustable length spaced tear portions in a workpiece sheet, said perforator wheel structure comprising:

a first wheel having a peripheral cutting edge provided with a plurality of circumferentially spaced first slots;

a second wheel having a peripheral cutting edge provided with a corresponding plurality of circumferentially spaced second slots; and screw means extending between said wheels adjustably securing said first and second wheels with said cutting edges juxtaposed and with said first slots overlapping said second slots to define nonslitting portions of said perforator wheel structure selectively having any one of a plurality of different lengths.

12. The perforator wheel structure of claim 1 wherein said screw means includes a camming screw.

13. The perforator wheel structure of claim 1 wherein said screw means includes a plurality of screws threaded to one of said wheels and extending through arcuate slots in the other of said wheels.

* * * * *